United States Patent [19]

Bishop

[11] 4,119,128

[45] Oct. 10, 1978

[54] TAMPERPROOF STERILE PORT COVER AND METHOD OF MAKING SAME

[76] Inventor: Marilyn Bishop, 1 N 341 Indian Knoll Rd., West Chicago, Ill. 60185

[21] Appl. No.: 770,237

[22] Filed: Feb. 18, 1977

[51] Int. Cl.[2] ..... B65D 31/02

[52] U.S. Cl. ..... 150/8; 206/634; 156/252

[58] Field of Search ..... 156/252, 263; 150/8; 128/214 D; 206/634

[56] References Cited

U.S. PATENT DOCUMENTS

| | | | |
|---|---|---|---|
| 2,161,093 | 6/1939 | Salfisberg | 206/634 |
| 3,086,647 | 4/1963 | Krezanoski | 206/634 X |
| 3,189,208 | 6/1965 | Jowett | 215/252 X |
| 3,306,292 | 2/1967 | Spees | 206/634 X |
| 3,473,650 | 10/1969 | Hoag | 206/634 |
| 3,509,879 | 5/1970 | Bathish | 128/214 D |
| 3,583,460 | 6/1971 | Faust | 150/8 |
| 3,788,374 | 1/1974 | Saijo | 150/8 X |
| 3,915,212 | 10/1975 | Bujan | 150/8 |
| 3,968,195 | 7/1976 | Bishop | 128/214 D X |
| 3,994,412 | 11/1976 | Difiglio | 128/214 D |

*Primary Examiner*—Donald F. Norton
*Attorney, Agent, or Firm*—Peter E. Heuser

[57] ABSTRACT

A sterile port cover which can be easily removed but is difficult to replace, and if replaced can be easily detected. A rigid port tube is sealably secured within a flexible plastic sleeve which extends beyond the end of the port tube. The sleeve is closed at this end and has a weakened section forming an intended fracture line. The sleeve is adapted to be separated at this fracture line and removed to expose the end of the port tube.

13 Claims, 7 Drawing Figures

FIG. 1
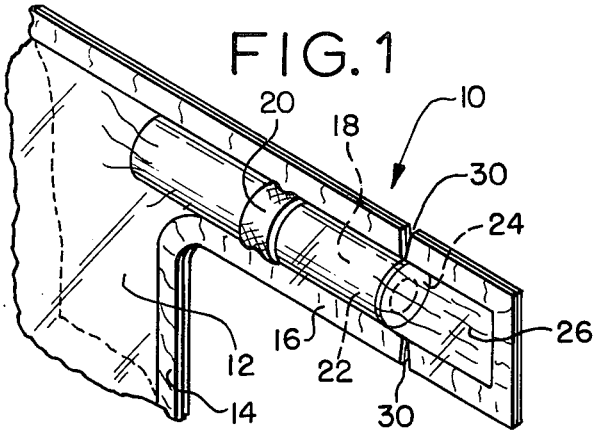
FIG. 3
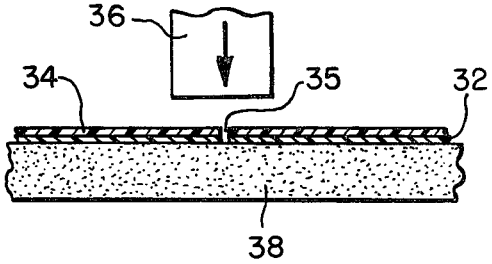
FIG. 2
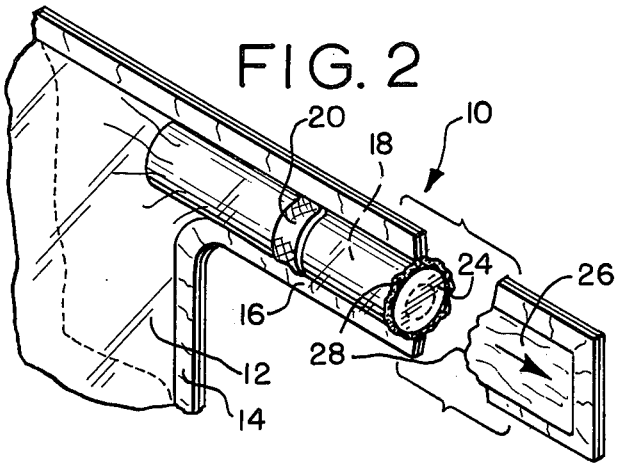
FIG. 4
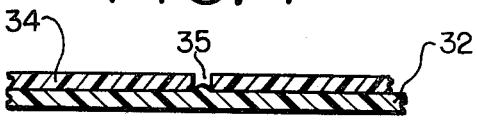
FIG. 6
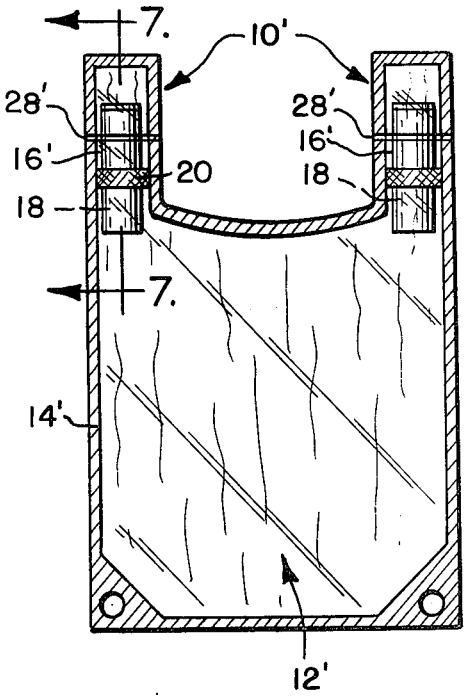
FIG. 5
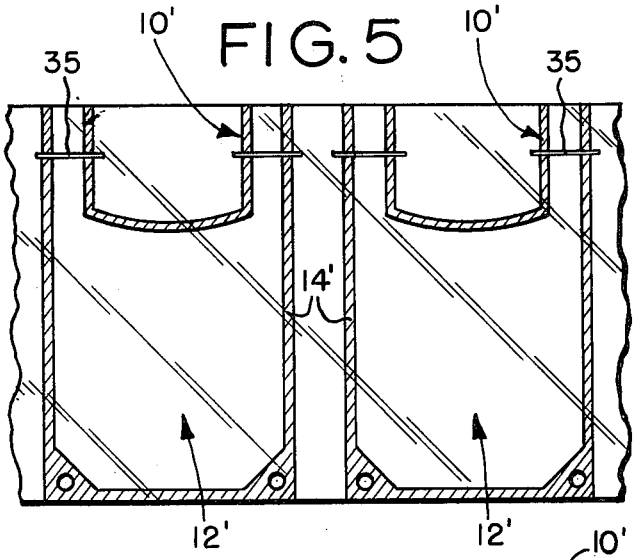
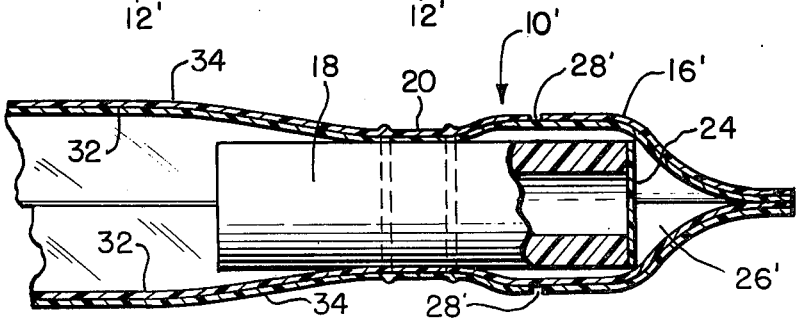
FIG. 7

TAMPERPROOF STERILE PORT COVER AND METHOD OF MAKING SAME

BACKGROUND OF THE INVENTION

This invention relates generally to containers for holding and passing sterile fluids or biological materials. More particularly the invention relates to a tamperproof sterile port cover for a rigid port tube which extends from a biological storage container.

At the present time there are numerous medical and scientific practices which require the sterile storage and transfer of fluids or other biological materials from one container to another. To facilitate sterile transfer, port tubes, such as those discussed in U.S. Pat. No. 3,968,195, are often utilized. Though these tubes are hereinafter characterized as "rigid", that term, as used herein, should not be construed synonymously with "brittle", but is intended to describe a structure having sufficient stiffness to maintain its shape under its own weight.

Various means have been utilized to cover port tubes to maintain the sterility of the unit. For example, removable caps, such as those depicted in the aforementioned U.S. Pat. No. 3,968,195, are often used. While these have proven generally adequate when the storage units are maintained in a sterile environment, serious drawbacks are evident when this is not the case. These caps are conventionally resealable, so it is impossible to determine whether any particular port has been continuously covered, and thus whether the sterility has been maintained. A second disadvantage is that the storage caps must be manufactured separately from the remainder of the storage unit. This factor will often increase the cost of the storage unit.

The first of these disadvantages, i.e., tamperability, has been remedied by the provision of a cover strip which extends around the tube as disclosed in U.S. Pat. No. 3,583,460. To open the port tube, the strip is peeled away. This cover is tamperproof but since the cover strip is manufactured separately from the remainder of the unit, the costs of manufacture and affixation to the port tube may be unreasonably high.

SUMMARY OF THE INVENTION

This invention responds to the problems presented in the prior art by providing a sterile port cover which is tamperproof and is manufactured as an integral part of the sterile container. The invention is adapted to cover a rigid port tube which is sealably secured within a flexible plastic sleeve which extends beyond the end of the port tube. The sleeve is closed at this end and has a weakened section forming a fracture line between the exterior end of the port tube and the part of the port tube which is secured to the sleeve. The sleeve is thus adapted to be separated at this fracture line and removed to expose the end of the port tube.

If the container sleeve unit is constructed of a laminate thermoplastic film, as is sometimes advantageous, the unit may be manufactured by severing the film and then applying heat until fewer then all of the laminates making up the film are reunited to form a continuous film. The container/sleeve unit is then formed from the film so that the sever line extends around the circumference of the sleeve. The rigid port tube is sealably secured therein so that the sever lies between the part of the port tube that is secured to said sleeve and the free end of the port tube.

The novel features which are believed to be characteristic of the invention are set forth in the appended claims. It is believed the invention will be best understood by reference to the following description taken in connection with the accompanying drawings in which:

FIGS. 1 and 2 are enlarged perspective views of the port structure before and after the cover has been separated and removed, respectively;

FIG. 3 is a cross-sectional view of a laminated film after it has been severed, just prior to the application of heat;

FIG. 4 is a cross-sectional view of the laminated film after heat has been supplied, depicting one of the laminates reunited to form a contiguous film;

FIG. 5 is an elevation view depicting the formation of the container/sleeve unit with the severs therein;

FIG. 6 is a cross-sectional view of the completed laminate container/sleeve unit with port tubes in place; and FIG. 7 is an expanded cross-sectional view of the laminated sleeve end taken along line 7—7 of FIG. 6.

DETAILED DESCRIPTION OF THE PREFERRED EMBODIMENTS

In one form of the invention chosen for the purpose of illustration in FIGS. 1 and 2, the port structure is shown generally at 10. This port structure 10 is one of several such ports which may be disposed about a container, used for holding or passing fluid or biological material. The container, a portion of which is shown at 12, is ordinarily formed entirely of two layers of thermoplastic material, heat sealed together to form a water-tight seam 14 around its periphery.

The port assembly 10 is comprised of a flexible thermoplastic sleeve 16 which is actually an extension of the container 12. A rigid port tube 18 is sealably secured within the sleeve 16. The term "sealably secured", as used herein, means that the port tube 18 should be sealed to the inner surface of the sleeve all the way around the outer diameter of the port tube so that fluid cannot pass between the sleeve 16 inner surface and the periphery of the port tube 18. The sealed surface need only be a narrow band such as that depicted at 20, leaving a free end 22. In at least one embodiment, however, as further discussed hereinbelow, the port tube 18 may be sealed along its entire length.

The sleeve 16 includes a heat-sealed end which extends beyond the free end 22 of the port tube 18 to form the cover tab 26. Further included in the sleeve 16 is a weakened section forming a fracture line 28 along which the sleeve may be broken. This fracture line 28 is located substantially between the exterior or free end 22 of the port tube and the band 20 where the rigid port tube 18 is secured to the sleeve 16. The fracture line 28 may be adjacent the free end 22 as depicted in FIGS. 1 and 2, in which case the port tube 18 may be sealed to the sleeve 16 along its entire length. The term "substantially" is used herein to describe the position of the fracture line 28 since it is conceivable that the fracture line could be positioned somewhat beyond the free end 22. This is not the preferred design, however, since the resultant overhanging film would be a potential cause of contamination and could complicate connection with another port tube, if such connection was desired. The presence of the weakened section of the sleeve 16 enables a user to sever the sleeve along fracture line 28 by squeezing the cover tab 26 against the free end 22 of the rigid port tube 18 with the thumb and index finger while pulling at same.

The port tube 18 includes a thin thermoplastic diaphragm 24 which seals off the free end 22 of the port tube 18. Diaphragm 24 preferably has relatively great thermoplastic properties, whereby the application of heat at free end 22 causes the softening and opening of diaphragm 24. Alternatively, the diaphragm 24 may be lanced by a standard transfer spike or cannula. It is preferred that cover tape 26 not be removed until a sterile connection is ready to be made or until the container 12 is to be emptied.

In the embodiment of FIGS. 1 and 2 this weakened section comprises notches 30 aligned on opposite sides of the sleeve seams 14. With many plastics used for these purposes, such as polyester or polyethylene coated polyester film, these notches will sufficiently weaken the sleeve 16 so that separation along the fracture line 28 is relatively easy. FIGS. 1 and 2 depict the port structure 10 before and after the cover tab 26 has been removed.

The port structure of FIGS. 1 and 2 is relatively simple to manufacture. As previously mentioned, the container/sleeve unit is preferably formed from two layers of thermoplastic film, heat sealed together along the edges to form watertight seams 14. The rigid port tube 18 is then inserted to an appropriate position with respect to notches 30, the notches being made either before or after the insertion of the port tube. The port tube is secured to the inner periphery of the sleeve and the sleeve end extending beyond the port tube is heat seamed to complete formation of the cover tab 26.

In some applications it may be desirable to use laminate thermoplastic film, such as nylon-polyethylene. A co-polymer such as ethyl vinyl acetate may also be used instead of polyethylene. With such a laminate, seam notching may not sufficiently weaken the sleeve to ensure a clean separation. With the embodiment depicted in FIGS. 6 and 7, indicated generally at 10', the inner laminate 32 is unsevered while the outer laminate 34 is severed, thus resulting in a weakened section along fracture line 28'. Film comprised of more than two laminates may be utilized and are intended to be within the scope of this invention. Of course, if this is the case it is necessary that at least one but fewer than all of the laminate layers be annularly severed to form the weakened sleeve section. As in the first embodiment, discussed hereinabove, the fracture line 28' should be substantially between the free end 22 of port tube 18 and band 20 where the port tube is secured to the sleeve 16.

The formation of port structure 10' is depicted in FIGS. 3 through 7. Initially it should be noted that the laminate layers should have different degrees of thermoplasticity. The reason for this is that the application of heat is intended to affect only one, ordinarily the inner, laminate 32.

The laminate film is fractured at various points along a predetermined, substantially straight, slit line. The spacing between the slits 35 must correspond to the dimensions of the container 12' as will become evident hereinbelow. The laminate in this severed condition is then subjected to heat as depicted schematically in FIG. 3. Heating element 36 may utilize intermittent electrical impulses to heat the severed portions as the laminate film is passed thereby, but any other conventional apparatus is adequate as long as the proper amount of heat is applied to substantially affect only one of the two laminates. Use of a resilient base pad 38 has proven advantageous to support the laminate film since it may be desirable to impress the heating element 36 against the film as the heat is applied. As depicted in FIG. 4, the application of heat (and pressure if necessary) removes the slits 35 in laminate 32 which has greater heat sensitivity than laminate 34. The slits 35 remain in laminate 34.

The container/sleeve unit is then formed by laying two sheets of laminate film back to back with the slits 35 in alignment. Preferably laminates 32 with greater heat sensitivity are positioned on the inside. Seams 14' are then heat-stamped as depicted in FIG. 5. The containers are trimmed and the port tubes 18 are inserted into the sleeves and sealed thereto as discussed hereinabove. The container 12' is thus fully formed with sleeves 16' having the outer laminate layer 34 annularly severed to form a weakened sleeve section 28'.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

What is claimed is:

1. A sterile port cover for a rigid port tube sealably secured within a flexible plastic sleeve, said cover comprising:

a closed end on said sleeve which extends beyond said port tube, said sleeve further having a weakened section forming a fracture line substantially between the exterior end of said port tube and the part of said port tube which is secured to said sleeve, wherein said sleeve is laminated and at least one and fewer than all of the laminate layers are annularly severed to form said weakened section, so that said sleeve is adapted to be separated at said fracture line and removed to expose the exterior end of said port tube.

2. The port cover of claim 1 wherein the inner laminate layer is unsevered.

3. The port cover of claim 1 wherein at least one of said laminate layers is thermoplastic and said laminate layers are of different degrees of heat sensitivity and wherein said weakened section is formed by severing said laminate layers and then applying heat to remove the severs from fewer than all of said laminate layers, thus resulting in a continuous port cover.

4. The port cover of claim 3 wherein the inner laminate layer has a greater degree of heat sensitivity than the remainder of said sleeve, so that when heat is applied the severs are removed from the inner laminate layer.

5. The port cover of claim 4 wherein said weakened annular section is adjacent the exterior end of said port tube.

6. The port cover of claim 3 wherein said sleeve is formed from two sheets of laminated plastic, seamed together along the longitudinal edges of said sleeve.

7. A method for forming a tamperproof sterile port cover of laminate thermoplastic film wherein the laminates are of different thermo-plasticity, comprising:

severing the film;

heating the film so that the sever is removed from at least one but fewer than all of the laminates making up the film, thus forming at least one continuous laminate in the film;

forming a sleeve from the film so that the sever line extends around the circumference of the sleeve;

inserting a rigid port tube and sealably securing said tube along part of its length within said sleeve so that the sever lies between the part of said port tube that is secured to said sleeve and the end of said port tube; and closing the sleeve end which extends beyond the sever and said port tube end, so that a tamperproof port cover is provided which may be removed by manually pulling the closed sleeve end and squeezing same off the port tube end edge.

8. A sterile port cover comprising:

a closed end sleeve with a generally transversely extending fracture line along which said sleeve is adapted to be severed, said sleeve being formed from two plastic sheets seamed together along the longitudinal edges of said sleeve, said sleeve having a thickness at said fracture line which is at least as great as the thickness of one of said sheets elsewhere in the sleeve, and a rigid port tube sealably secured within said sleeve, said fracture line positioned substantially between the exterior end of said port tube and the part of said port tube which is secured to said sleeve, said sleeve having notches at said sleeve seams aligned with said exterior end of said port tube, so that said fracture line generally follows said exterior end of said port tube.

9. A sterile port cover comprising:

a closed end sleeve with a generally transversely extending fracture line along which said sleeve is adapted to be severed, said sleeve formed of a plurality of layers of plastic, with at least one and fewer than all of said layers annularly severed, and with at least one of said layers having a thickness at said fracture line which is at least as great as its thickness elsewhere in the sleeve.

10. A sterile port cover comprising:

a closed end laminated sleeve having at least one and fewer than all of the laminates annularly severed to form a fracture line extending generally transversely across said sleeve, so that said sleeve is adapted to be separated at said fracture line.

11. The sterile port tube of claim 10 wherein said laminate sleeve is thermoplastic with said laminate layers being of more than one degree of heat sensitivity and wherein said fracture line is formed by severing said sleeve and then applying heat to remove the severs to fewer than all of said layers, thereby forming a continuous port cover.

12. The sterile port cover of claim 11 wherein the inner laminate layer has greater heat sensitivity than any of the other layers, and a sufficient amount of heat is applied to remove the severs from only the inner laminate layer.

13. A tamperproof port cover comprising a flexible sleeve having a closed end, said sleeve formed from sheets seamed together along their longitudinal edges, and a rigid port tube sealabley secured within said sleeve said sleeve further having a weakened section forming a fracture line, said weakened section comprising aligned notches at opposite sides of said sleeve seams so that said sleeve is adapted to be separated along said fracture line, said fracture line coinciding with the exterior end of said port tube so that when said sleeve is separated along said line, the exterior end of said tube is exposed.

* * * * *